US010602825B2

(12) United States Patent
Ngo

(10) Patent No.: US 10,602,825 B2
(45) Date of Patent: Mar. 31, 2020

(54) STEAM HAIRSTYLING APPLIANCE HAVING A REDUCED-SIZE BASE

(71) Applicant: SEB S.A., Ecully (FR)

(72) Inventor: Eddy Ngo, Lyons (FR)

(73) Assignee: SEB S.A., Ecully (FR)

( * ) Notice: Subject to any disclaimer, the term of this patent is extended or adjusted under 35 U.S.C. 154(b) by 396 days.

(21) Appl. No.: 15/120,843

(22) PCT Filed: Feb. 24, 2015

(86) PCT No.: PCT/FR2015/050440

§ 371 (c)(1),
(2) Date: Aug. 23, 2016

(87) PCT Pub. No.: WO2015/128576

PCT Pub. Date: Sep. 3, 2015

(65) Prior Publication Data

US 2016/0360850 A1 Dec. 15, 2016

(30) Foreign Application Priority Data

Feb. 28, 2014 (FR) ..... 14 51645

(51) Int. Cl.
*A45D 19/16* (2006.01)
*A45D 1/04* (2006.01)
(Continued)

(52) U.S. Cl.
CPC ..... *A45D 19/16* (2013.01); *A45D 1/04* (2013.01); *A45D 2/001* (2013.01); *A45D 2/40* (2013.01); *A45D 2001/008* (2013.01)

(58) Field of Classification Search
CPC . A45D 19/16; A45D 1/02; A45D 1/04; A45D 2/001; A45D 2001/008;
(Continued)

(56) References Cited

U.S. PATENT DOCUMENTS 5,765,572 A 6/1998 Paget et al.
8,237,089 B2 8/2012 Legrain et al.

FOREIGN PATENT DOCUMENTS

EP 0619087 A1 4/1994
FR 2802195 A1 * 6/2001
(Continued)

OTHER PUBLICATIONS

Machine Translation of FR2802195, accessed at EPO website Sep. 10, 2018.*

(Continued)

*Primary Examiner* — Edward Moran

(74) *Attorney, Agent, or Firm* — The Webb Law Firm

(57) ABSTRACT

A steam appliance intended to style hair, includes: —a base having a fluid reservoir including a component for demineralizing the fluid that is arranged upstream of the reservoir, —an intermediate chamber for raw fluid, the intermediate chamber being arranged upstream of the demineralizing component, —a cover intended to closed the intermediate chamber, —a portable unit for styling the hair, the unit being remote from the base and having a component for outputting steam in the direction of the hair, —a line including at least one duct intended to put the base and the portable unit into fluid communication, —a component for vaporizing the fluid and a component for outputting steam in the direction of the hair. The intermediate chamber includes in its interior a splitter intended to increase the flow cross section of the fluid through the inlet of the demineralizing component.

11 Claims, 5 Drawing Sheets

(51) Int. Cl.
*A45D 2/00* (2006.01)
*A45D 2/40* (2006.01)
*A45D 1/00* (2006.01)

(58) Field of Classification Search
CPC ..... B01J 47/024; D06F 75/14; D06F 75/10; C02F 1/002; C02F 1/003; C02F 2103/026; A61B 34/10; B01D 29/01; B01D 29/03; B01D 29/05; B01D 29/88; B01D 29/90; B01D 29/96; B01D 35/02; B01D 35/027; B01D 35/0273; B01D 35/28; B01D 2201/313; B01D 2201/24; B01D 2221/02
USPC ..... 132/227–228; 392/403, 405, 406
See application file for complete search history.

(56) References Cited

FOREIGN PATENT DOCUMENTS

| | | | |
|---|---|---|---|
| FR | 2967022 | A1 | 5/2012 |
| WO | 2008/129172 | A2 | 10/2008 |
| WO | 2009/004191 | A2 | 1/2009 |

OTHER PUBLICATIONS

Machine Translation of FR2967022, accessed at EPO website Sep. 10, 2018.*

* cited by examiner

STEAM HAIRSTYLING APPLIANCE HAVING A REDUCED-SIZE BASE

CROSS-REFERENCE TO RELATED APPLICATIONS

This application is the United States national phase of International Application No. PCT/FR2015/050440 filed Feb. 24, 2015, and claims priority to French Patent Application No. 1451645 filed Feb. 28, 2014, the disclosures of which are hereby incorporated in their entirety by reference.

FIELD OF THE INVENTION

This invention pertains to a hairstyling appliance using steam, designed to style the hair by contact, particularly intended for smoothing, curling or crimping a person's hair.

DESCRIPTION OF RELATED ART

As described in patent document FR 2967022 filed in the applicant's name, there already exists a hairstyling appliance comprising a base with a fluid reservoir and a hand-held unit for styling hair. The appliance also comprises a means of vaporizing the fluid and a means of emitting the steam, as well as a line connecting the hand-held unit and the base in order to transmit the fluid. In order to ensure the proper functioning of the appliance and increase the product's lifespan, the appliance comprises, in the base, a means of demineralizing the fluid, thereby making it possible to reduce the hardness of the raw fluid used as input for the appliance. Such demineralization purifies the raw fluid and decarbonates it, or in other words removes the scale ($CaCo_3$) from the fluid, such as raw tap water added to the appliance by the user.

According to this document, the base has a cover with a fixed portion covering the upper part of the reservoir and a mobile portion for adding fluid to the base. The fluid thus added is distributed consistently over the entire upper portion of the reservoir, thereby ensuring an even rate of flow into the demineralization means in order to optimize the efficacy of the demineralization.

However, such a configuration requires a specific arrangement of the mobile portion of the cover. Indeed, in order for the fluid to be able to run across the entire upper portion of the reservoir before flowing into the demineralization means, it is necessary for the mobile portion through which the fluid is added to be offset from the inlet of the demineralization means by a far enough distance, and not just above it. This requirement can be limiting in the use of the appliance, and all the more so when one wishes to reduce the bulk of the base.

The purpose of this invention is to remedy, at least in part, the aforementioned disadvantages and to provide a hairstyling appliance using steam that offers a high-quality hair treatment, while lengthening the lifespan of the product.

Another purpose of the invention is a hairstyling appliance using steam that can ensure continuous—or even constant—steam output, corresponding to the control setting.

Another purpose of the invention is a hairstyling appliance using steam that is less bulky, at least with regard to the base.

Another purpose of the invention is a hairstyling appliance using steam with fewer parts and a lower production cost.

Another purpose of the invention is a hairstyling appliance using steam in which the liquid reservoir can be filled in a quick, easy, intuitive manner.

Another purpose of the invention is an appliance for styling hair by contact, using steam and additional disposable components that are simple and inexpensive by design.

SUMMARY OF THE INVENTION

These purposes are achieved with a steam hairstyling appliance comprising a base with a fluid reservoir comprising a means of demineralizing the fluid arranged upstream of said reservoir, an intermediate chamber for raw fluid arranged upstream of said demineralization means, and a cover designed to close said intermediate chamber. The appliance comprises a hand-held unit for styling the hair, remote from the base, the unit having a means of emitting steam toward the hair, and a line with at least one duct designed for establishing fluid communication between the base and the hand-held unit. The appliance also comprises a means of vaporizing the fluid and a means of emitting steam toward the hair. In the invention, the interior of said intermediate chamber comprises a disperser designed to increase the flow cross-section of the fluid through the inlet of the demineralization means.

The intermediate chamber makes it possible to add the raw fluid intended to pass through the demineralization means and to be stored as a purified fluid in the reservoir. It allows for quick filling with a delay for demineralization. Said disperser is arranged, like the intermediate chamber, upstream of the demineralization means at a distance that is far enough away for the fluid to flow uniformly through the entire intermediate chamber. This makes it quick and intuitive for the user to fill, since he is no longer required to add the fluid through an opening with a precise position. It becomes possible to add the fluid at any location of the intermediate chamber, without filling it up in a vertical position, which makes the demineralization ineffective.

Advantageously, said disperser is symmetrical with respect to a central axis (A), said disperser having a surface (S) on the cover side, designed to receive the raw fluid and to make it flow into said intermediate chamber. This makes it possible to disperse the flow and forces it to run over the entire intermediate chamber.

In addition, said surface (S) is at least partially inclined toward the demineralization means from said central axis (A). This makes it possible to effectively guide the flow so that it is distributed over the entire intermediate chamber, regardless of the place where the fluid falls.

In addition, said reservoir comprises, at the fluid inlet, a means of adjusting the flow. This makes it possible to ensure a maximum flow of fluid let into the demineralization means, and an even flow rate.

In this configuration, said disperser is attached roughly at its center to said flow adjustment means by a clip. Thus, the disperser remains inside the intermediate chamber by a quick, inexpensive means of attachment.

In order to optimize the distribution of the fluid, the edges of said disperser are roughly flush with the edges of the flow adjustment means. This ensures that the fluid runs over the entire surface of the bottom of the intermediate chamber.

Advantageously, the periphery of said intermediate chamber has a roughly elongated shape with two rounded ends. In one method of implementation, it is rectangular in shape with the two shorter segments being rounded. This shape makes the appliance more compact and more aesthetically pleasing.

In addition, the crosswise distance between said disperser and at least one portion of the periphery of the intermediate chamber is roughly constant.

In order to prevent any splashing of fluid, while ensuring the proper functioning of the demineralization process, the distance between the center of the disperser and the flow adjustment means is between 5 mm and 35 mm, and preferably 24 mm. And the distance between the ends of the disperser and the flow adjustment means is between 4 mm and 34 mm, and preferably 7 mm.

Advantageously, the demineralization means comprises a main chamber containing ion-exchange resin, this main chamber being detachable from the base in order to replace the resin once it is no longer effective.

Advantageously, said flow adjustment means is an identical mesh filter. The filter adjusts the flow and prevents the demineralization means from coming out of the base when said base is turned upside down.

Finally, for quick, intuitive filing, the lid is detachable from the reservoir.

BRIEF DESCRIPTION OF THE DRAWINGS

The invention will be better understood upon review of the method of implementation illustrated in the attached drawings and which is in no way limiting, in which.

DETAILED DESCRIPTION OF THE INVENTION

Figure 1:
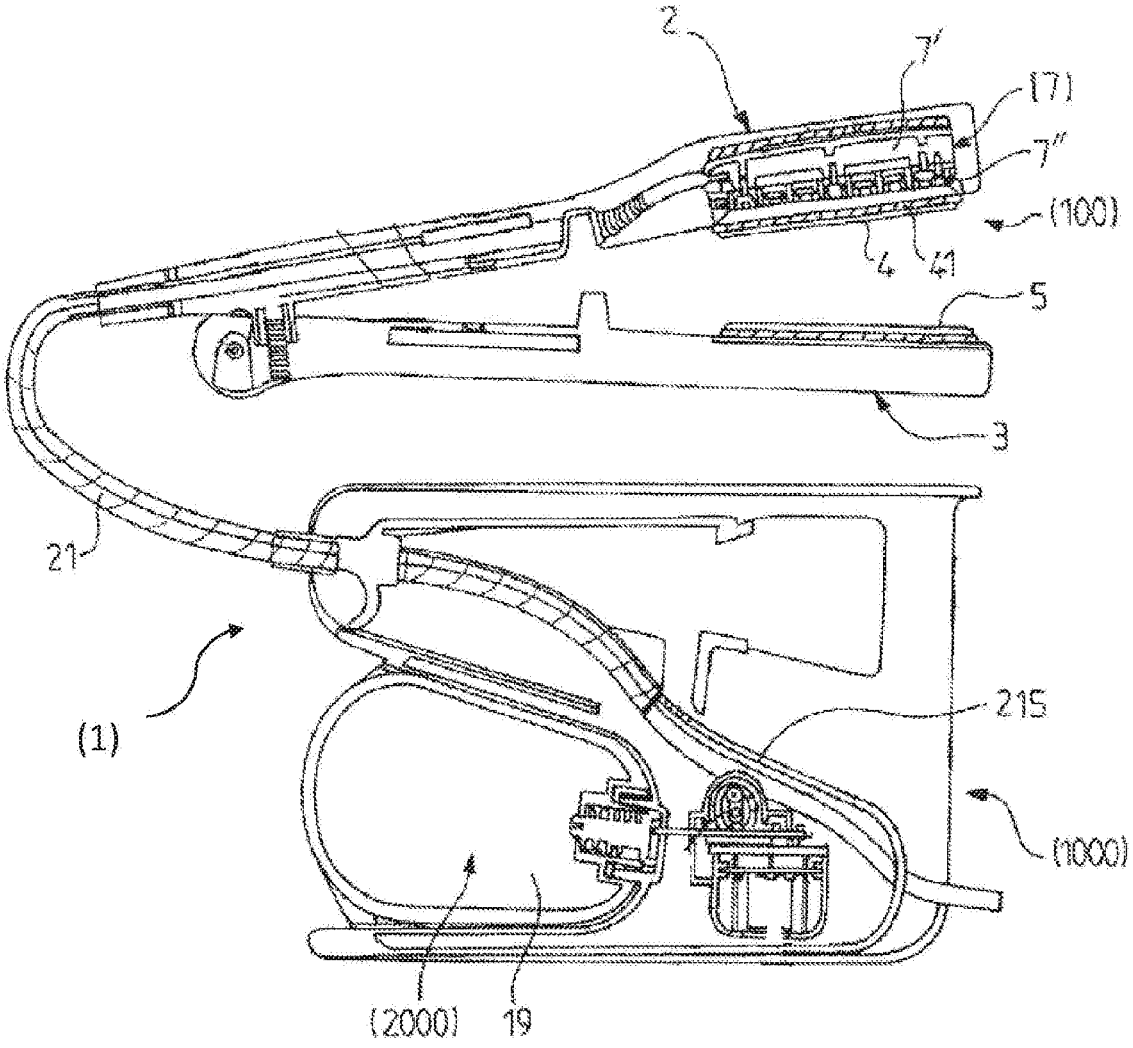
FIG. 1 depicts a view of an appliance described in the invention.

As depicted in FIG. 1, the invention pertains to an appliance (1) designed to style hair, comprising a base (1000) comprising a fluid reservoir (19), a hand-held unit (100) comprising a means of vaporizing the fluid (7), a means of emitting steam (7', 7") toward the hair, a line (21) having at least one duct (215) designed to transmit fluid and arranged between the reservoir (19) and the vaporizing means (7), the hand-held unit (100) comprises only or at least one first treatment surface (4) designed to come into contact with the hair, and the fluid vaporizing means (7) is arranged exclusively in the hand-held unit (100). The base is referred to as "remote" from the hand-held unit, and can be placed on a work surface. The base has a receptacle for holding the hand-held appliance or handpiece when it is not in use. The base (1000) has a demineralization means (2000) which reduces the calcium content of the fluid added to the base. This demineralization means is arranged between an intermediate chamber (2100), which receives the "raw" fluid, and the reservoir (19), which contains the "purified" fluid intended for the hairstyling appliance.

Still in reference to FIG. 1, the hand-held unit (100) comprises a heating means (41) to heat the first treatment surface (4). It can be a heating element (41) which can be a positive temperature coefficient thermistor or a ceramic one that is pressed against the treatment surface (4) or arranged inside the element comprising the treatment surface (4). The fluid vaporizing means (7) has a vaporization chamber (7') and a means of heating the vaporization chamber (7'). The one or more chamber(s) are made of aluminum and have openings for emitting steam (7") toward the hair. The hand-held unit (100) also comprises a first jaw (2) and a second jaw (3) positioned facing one another, the first treatment surface (4) being held by the first jaw (2), a second treatment surface (5) being held by the second jaw (3), the jaws being connected so as to move from an open position to a closed position, such that the surfaces (4, 5) pinch a lock of hair.

In the example depicted, the appliance comprises a heating means to heat the second treatment surface (5) of the same type as that of the first treatment surface (4). The first surface (4) and the second surface (5) for treating the hair are complementary surfaces illustrated as flat, which, in the closed position of the appliance, roughly fit together, but can also be either curved or wavy. A curling appliance, such as the one described in patent EP0619087 or EP2152114 can be cited as an example. A curling appliance pertains to a hair treatment and/or styling appliance, preferably for manual use, with the following: arranged stemming from a main body, a gripping means, a rolling body for locks of hair, preferably assembled in a freely rotating manner on the main body around its longitudinal axis and at least one mobile clamp to squeeze the lock of hair onto the body. A crimping appliance is an appliance equipped with two jaws facing one another, each with a non-flat treatment surface, as described in patent WO2008129172, for example.

Figure 2:
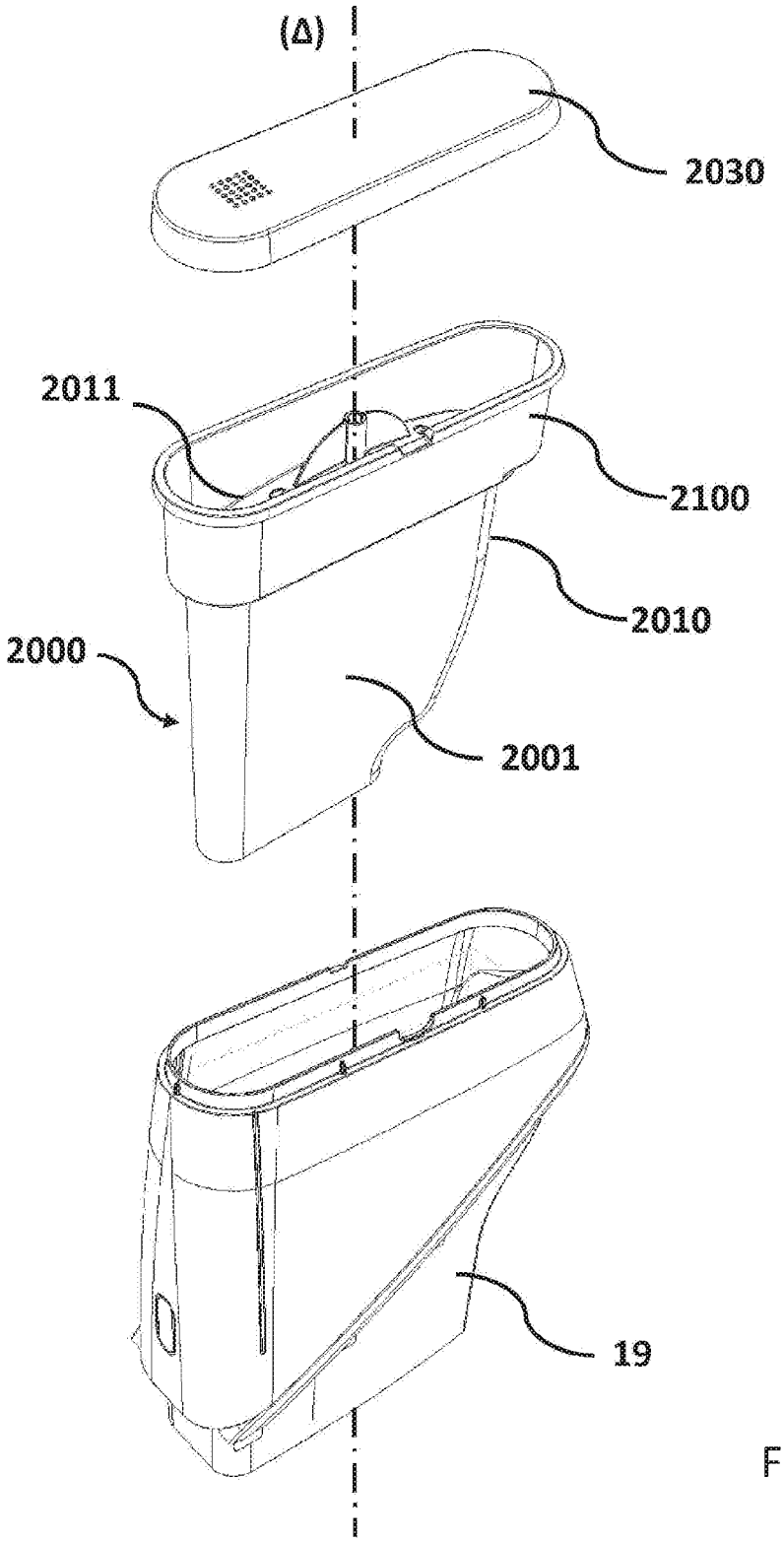
FIG. 2 depicts an exploded view of the reservoir, demineralization means, intermediate chamber and lid.

As depicted in FIG. 2, the base (1000) comprises a fluid reservoir (19) and a demineralization means (2000) arranged upstream, entirely above the reservoir (19). The demineralization means (2000) comprises a main chamber (2010) containing ion-exchange resin (2001), said main chamber (2010) is a cartridge that is completely removable from the base (1000), which can be changed, disposed of and replaced with an identical cartridge once the resin is no longer effective. The base also comprises an intermediate chamber (2100) arranged upstream of and in fluid communication with the demineralization means (2000). The intermediate chamber is connected, in an airtight manner, to the cartridge, and it is arranged at least partially higher than the demineralization means (2000), the demineralization means (2000) being arranged at least partially higher than the main fluid reservoir (19). Finally, the base (1000) comprises a cover (2030) designed to close the intermediate chamber (2100). This cover (2030) is detachable from the base for filling the intermediate chamber (2100) with fluid in a quick, intuitive manner. This also makes it possible to replace the cartridge. The appliance comprises a means of transmitting fluid from the reservoir (19) to the hand-held unit, which is described in detail in patent application FR 2967022.

Figure 3:
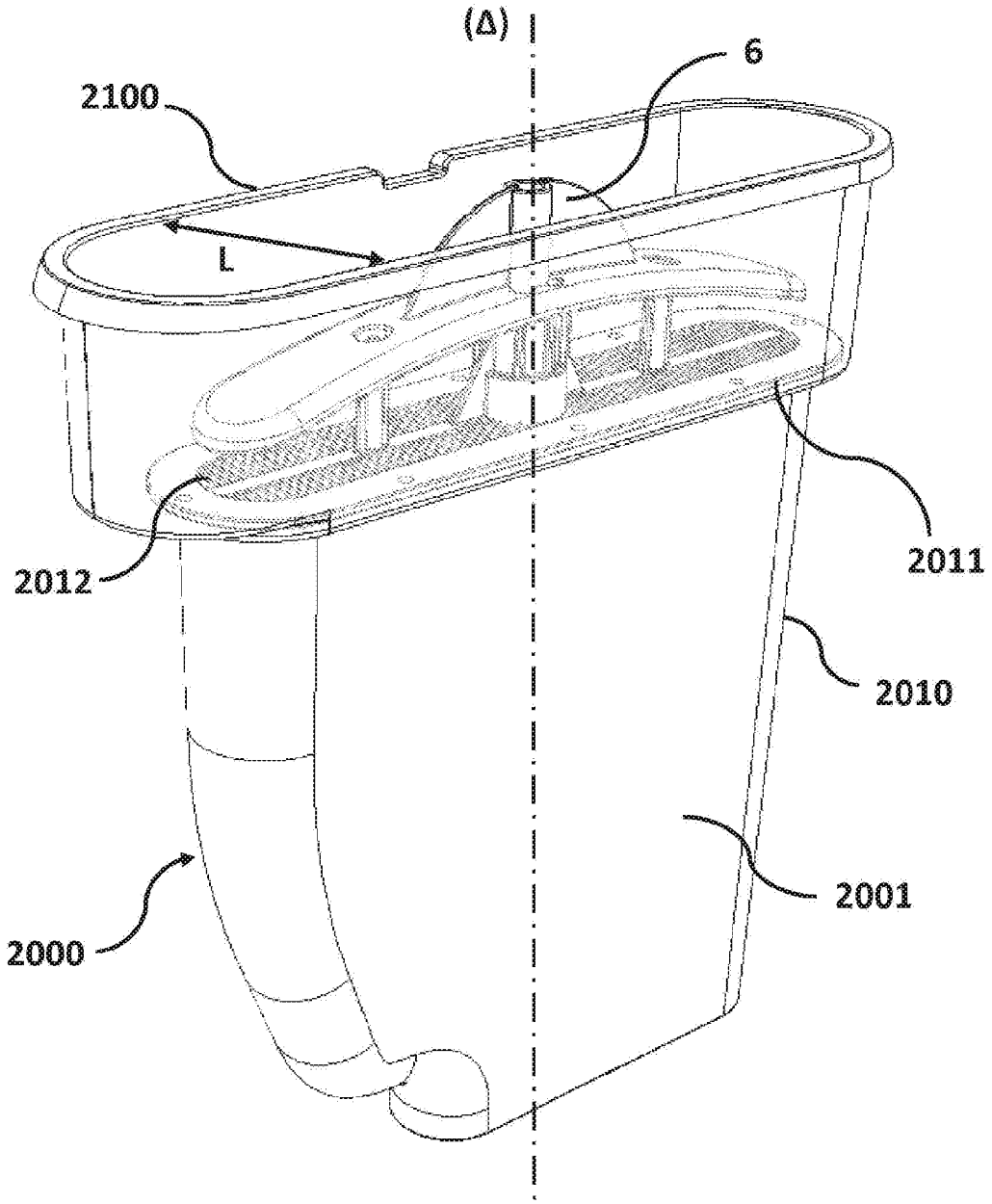
FIG. 3 depicts a view of the arrangement of the disperser in the base.
Figure 4:
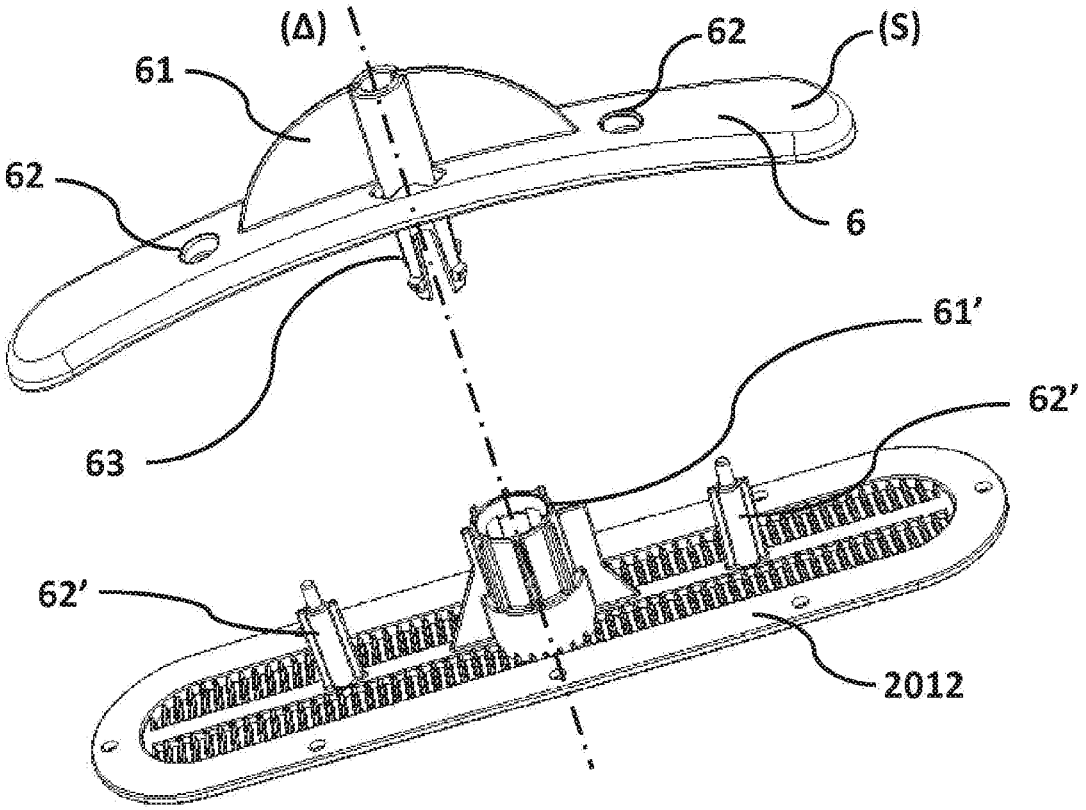
FIG. 4 depicts an exploded view of the disperser and the flow adjustment means.
Figure 5:
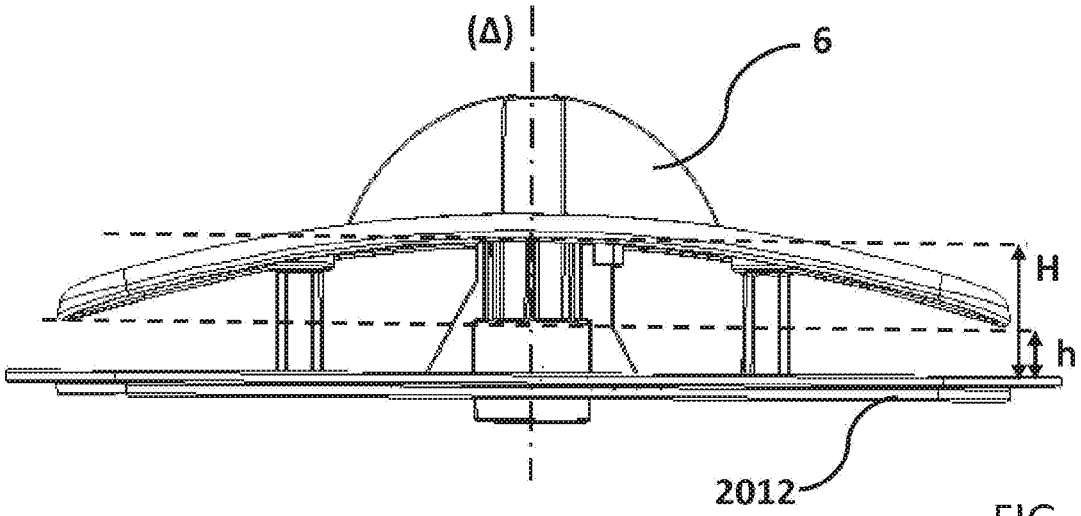
FIG. 5 depicts a view of the disperser assembled on the flow adjustment means.

As shown in FIGS. 3, 4 and 5, the interior of the intermediate chamber (2100) comprises a part referred to as a "disperser" (6) designed to increase the flow cross-section of the fluid through the inlet of the demineralization means. The term "inlet of the demineralization means" refers to the inlet (2011) of fluid from the intermediate chamber (2100) to the resin chamber (2010) before reaching the reservoir (19) as a purified fluid. Said fluid inlet (2011) is therefore arranged between the intermediate chamber (2100) and the resin chamber (2010), in a roughly horizontal manner for a larger usable cross-section. As seen above, it is necessary to remove the cover (2030) in order to fill the intermediate chamber (2100), the result of which is that the fluid can fall anywhere in the fluid inlet (2011), especially when the fluid is added in the vertical position, for example when tap water is used. The raw fluid can then immediately pass through the fluid inlet (2011) without having the time to spread over its entire cross-section. Consequently, the liquid flow capacity in the demineralization means (2000) is too great, due to a small flow cross-section of the fluid through the inlet, which lowers the efficacy of the exchange.

In order to prevent this, the disperser (6) is a symmetrical part with a central axis (A) having a surface (S) designed to receive the raw fluid. Said surface (S) is located on the cover side (2030), toward the top of the central axis (A). The disperser (6) may be in the shape of an umbrella or even, as in the example depicted, an elongated shape with a surface (S) that is inclined from the center toward the demineralization means (2000), or in other words, toward the bottom of the central axis (A). Thus, the disperser (6) eliminates the preferred flow path and guides the fluid to flow over the entire cross-section of the fluid inlet (2011).

As depicted in FIG. 3, said fluid inlet (2011) is covered by a flow adjustment means (2012), which is an identical mesh filter. The filter makes it possible to filter out the impurities contained in the water, as well as to adjust the flow capacity. At its center, the filter has a cylinder (61') designed to receive a shaft (63) provided with a hooking means, the shaft (63) being attached to the disperser (6) on the central axis (A). Thus, the disperser (6) is attached at its center to a filter by a clip between the shaft (63) and the cylinder (61'). Moreover, on each side of the cylinder (61'), the filter has a finger (62') designed to be inserted into corresponding holes (62) arranged on the disperser (6) to reinforce the attachment. The disperser (6) comprises, on the surface (S), a handle (61) for gripping the disperser (6) and the demineralization means (2000) when changing the resin. The disperser (6) can also be press fitted, welded or riveted onto the filter (2012) depending on production requirements, or it can simply be placed on the filter (2012) without being attached.

Figure 6:
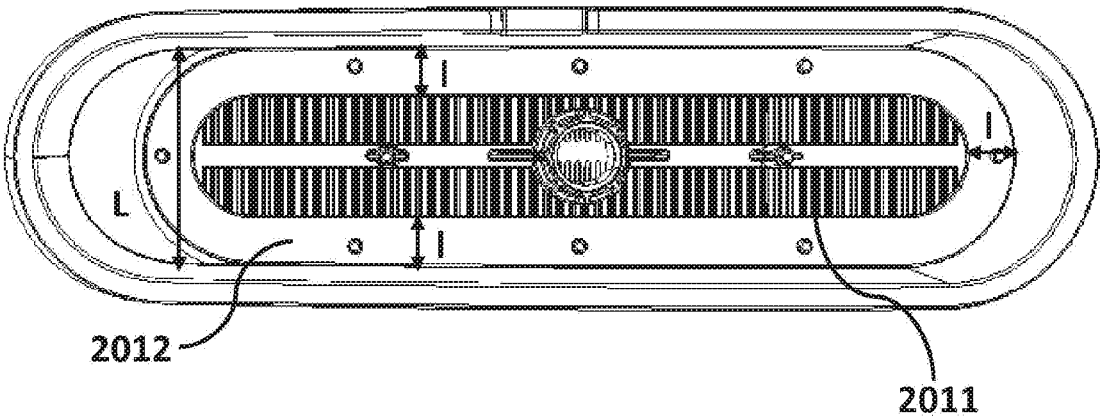
FIG. 6 depicts a view from above of the intermediate chamber.
Figure 7:
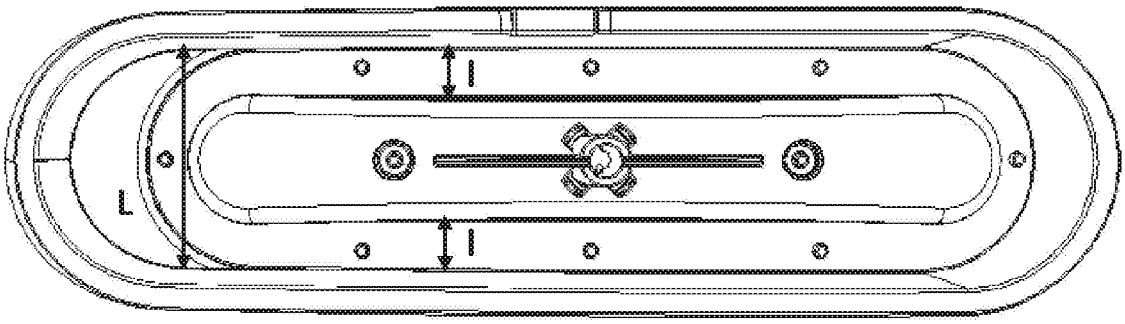
FIG. 7 depicts a view from above of the intermediate chamber with the disperser.

In one method of implementing the invention and as shown in FIG. 3, the intermediate chamber (2100) is roughly elongated in shape at a constant width (L). The two ends are rounded to semi-circles. As depicted in FIG. 6, the fluid inlet (2011), as well as the filter (2012), essentially take on this shape with a crosswise spread (I) of approximately 5 mm with respect to the periphery of the length and of one of the ends of the intermediate chamber (2100). As depicted in FIG. 7, the edges of the disperser (6) are flush with the edges of the filter (2012) on the length. The crosswise distance between the disperser (6) and the periphery of the intermediate chamber (2100) on the length is therefore equal to the crosswise spread (I).

As shown in FIG. 5, the first distance (H) between the center of the disperser (6) and the filter (2012) is equal to the length of the cylinder (61'), said length being between 5 mm and 35 mm, and preferably 24 mm. The second distance (h) between the ends of the disperser (6) and the filter (2012) is equal to the length of the fingers (62'), said length being between 4 mm and 34 mm, and preferably 7 mm.

Finally, said disperser (6) is a thermoplastic piece. It can also be made of PET (polyethylene terephthalate) or even PS (polystyrene).

Advantages of the Invention

The invention offers numerous advantages, which include providing an appliance:

with compact means that can offer high-quality hair treatment while extending the lifespan of the product;

that can provide continuous—or even constant—steam output;

that makes it possible to fill the liquid reservoir in a quick, easy, intuitive manner;

that is solid, durable in operation, and ages well;

with effective and/or quick operation;

that is airtight while operating;

that is easy and practical to use;

that is made in a simple, inexpensive manner, including the disposable components;

with a simplified structure;

that is inexpensive to manufacture.

Of course, the invention is in no way limited to the method of implementation described and illustrated, which has been provided only as an example. Modifications remain possible, particularly with regard to the composition of the various components or by substituting equivalent techniques, while still remaining within the scope of protection of the invention.

The invention claimed is:

1. A steam hair styling appliance, comprising:

A base with:

A fluid reservoir comprising a fluid demineralization means arranged upstream of said reservoir, An intermediate chamber for raw fluid arranged upstream of said demineralization means, A cover designed to close said intermediate chamber, A hand-held unit for styling hair, remote from the base, A line with at least one duct designed for establishing fluid communication between the base and the hand-held unit, A fluid vaporizing means and a means of emitting steam toward the hair a flow adjustment means positioned at an inlet of the demineralization means and comprising a cylinder, wherein the interior of said intermediate chamber comprises a disperser designed to increase the flow cross-section of the fluid the an inlet of the demineralization means, and wherein the disperser comprises: (i) a handle attached to a top side of a surface that faces a bottom side of the cover, the surface being inclined from a central axis toward the demineralization means; and (ii) a shaft that extends through the handle and the surface at the central axis, wherein the shaft attaches to the cylinder of the flow adjustment means positioned below the surface and which creates a space between the surface and the flow adjustment means, and wherein the surface guides the fluid to flow over the entire cross-section of the inlet into said intermediate chamber.

2. The hair styling appliance described in claim 1, wherein said disperser is symmetrical with respect to the central axis.

3. The hair styling appliance described in claim 1, wherein said reservoir comprises, at a fluid inlet, the flow adjustment means.

4. The hair styling appliance described in claim 1, wherein edges of said disperser are flush with edges of the flow adjustment means.

5. The hair styling appliance described in claim 1, wherein a periphery of said intermediate chamber is elongated in shape, with two rounded ends.

6. The hair styling appliance described in claim 5, wherein a crosswise distance between said disperser and at least one portion of the periphery of the intermediate chamber is constant.

7. The hair styling appliance described in claim 1, wherein a distance between a center of the disperser and the flow adjustment means is between 5 mm and 35 mm.

8. The hair styling appliance described in claim 1, wherein a distance between ends of the disperser and the flow adjustment means is between 4 mm and 34 mm.

9. The hair styling appliance described in claim 1, wherein the demineralization means comprises a main chamber containing ion-exchange resin, wherein said main chamber is detachable from the base to permit replacement of the resin after the resin is no longer effective.

10. The hair styling appliance described in claim 1, wherein said flow adjustment means is a mesh filter.

11. The hair styling appliance described in claim 1, wherein the cover is detachable from the reservoir.

* * * * *